United States Patent [19]

Yasuoka

[11] Patent Number: 4,934,849

[45] Date of Patent: Jun. 19, 1990

[54] APPARATUS FOR FEEDING RECORDING PAPER FORWARDLY AND BACKWARDLY

[75] Inventor: Tadashi Yasuoka, Tokyo, Japan

[73] Assignee: Seikosha Co., Ltd., Japan

[21] Appl. No.: 162,891

[22] Filed: Mar. 2, 1988

[30] Foreign Application Priority Data

Mar. 2, 1987 [JP] Japan ..... 62-47059

[51] Int. Cl.[5] ..... B41J 19/14

[52] U.S. Cl. ..... 400/551; 400/616; 400/618

[58] Field of Search ..... 400/618, 551, 616

[56] References Cited

U.S. PATENT DOCUMENTS 4,360,279 11/1982 Sugiura ..... 400/618
4,606,663 8/1986 Christoph et al. ..... 400/605

FOREIGN PATENT DOCUMENTS 113587 9/1980 Japan ..... 400/551
118883 9/1981 Japan ..... 400/618
39980 3/1982 Japan ..... 400/618
116563 6/1986 Japan ..... 400/551
116568 6/1986 Japan ..... 400/618

*Primary Examiner*—Edgar S. Burr
*Assistant Examiner*—Joseph R. Keating
*Attorney, Agent, or Firm*—Bruce L. Adams; Van C. Wilks

[57] ABSTRACT

An apparatus for feeding recording paper forwardly and backwardly in a printing apparatus comprising a pair of paper feed devices, one on each side of a printing unit. The upstream paper feed device is lower in forward feed speed than the downstream paper feed device. The apparatus includes a larger- and a smaller-diameter gear portions provided integrally on a drive gear wheel which transmits a drive force to the upstream paper feed device. A reverse-feed gear wheel, mounted on the drive shaft, meshes with the larger-diameter gear portion via a one-way clutch. A forward-feed gear wheel, loosely fitted over the drive shaft, meshes with the smaller-diameter gear portion. A clutch spring, wound around the outer periphery of the shaft of the forward feed gear wheel and a seat coupled to the drive shaft, is engaged with a rotary body with a one-way clutch.

10 Claims, 5 Drawing Sheets

APPARATUS FOR FEEDING RECORDING PAPER FORWARDLY AND BACKWARDLY

BACKGROUND OF THE INVENTION

This invention relates to an apparatus for forwardly and backwardly feeding continuous printing paper while the paper is being printed by a printer.

A conventional printer has paper feed means at each of both the sides of a printing means in which a paper feed rate of the paper feed means positioned upstream when a recording paper is fed forwardly is set so as to be lower than that of paper feed means positioned downstream. This is because slight tension is applied to the recording paper under which condition printing is performed to thereby improve the quality of printing.

PROBLEMS THAT THE INVENTION IS INTENDED TO SOLVE

The fact that the paper feed rate of the upstream paper feed means is lower than that of the downstream paper feed means is acceptable when the paper is fed forwardly, but reversing the feed of paper in the halfway of printing would cause slackness in the paper because of the feed rate difference, so that it is necessary to limit a quantity of paper feeding, for example, to about one third of one page.

It is therefore an object of this invention to provide a forward and backward feed apparatus which completely avoids the necessity of limiting the backward feeding quantity of recording paper, for example, continuous paper.

SUMMARY OF THE INVENTION

In order to achieve the above object, the feature of this invention is to provide a pair of paper feed means, one on each side of a printing means. A larger-diameter gear portion and a smaller-diameter gear portion are provided as a two-stepped structure on a drive gear wheel which transmits a drive force to a drive shaft of the upstream paper feed means. A reverse-feed gear wheel is mounted on the drive shaft to mesh with the larger-diameter gear portion via a one-way clutch and a forward-feed gear wheel is loosely fitted over the drive shaft to mesh with the smaller-diameter gear portion. A seat is fixed to the drive shaft, and a clutch spring is wound around the outer periphery of a shaft of the forward feed gear wheel and the seat with one end portion of the spring being engaged with a rotary body. The rotary body is mounted on a bearing via a one-way clutch.

Thus, when the paper is fed forwardly, the drive force is transmitted from the small-diameter gear portion via the forward feed gear wheel, clutch spring and seat to the drive shaft. At this time the upstream paper feed means is lower in paper feed rate than the downstream paper feed means. When the paper is fed backwardly, the transmission from the smaller-diameter gear portion is impossible, and the drive force is transmitted from the larger-diameter gear portion via backward feed gear wheel, and one-way clutch to the drive shaft.

Therefore, at the backward feeding, the drive force is transmitted from the larger-diameter gear portion to the gear wheel, so that the gear wheel is more accelerated than at the forward feeding, the drive shaft at the backward feeding is increased in rotational speed and rotates at higher speed than the downstream paper feed means at the forward feeding.

BRIEF DESCRIPTION OF THE DRAWINGS

The drawings show one embodiment of this invention.

DETAILED DESCRIPTION OF THE INVENTION

An embodiment of this invention will now be described with reference to the drawings.

Figure 1:
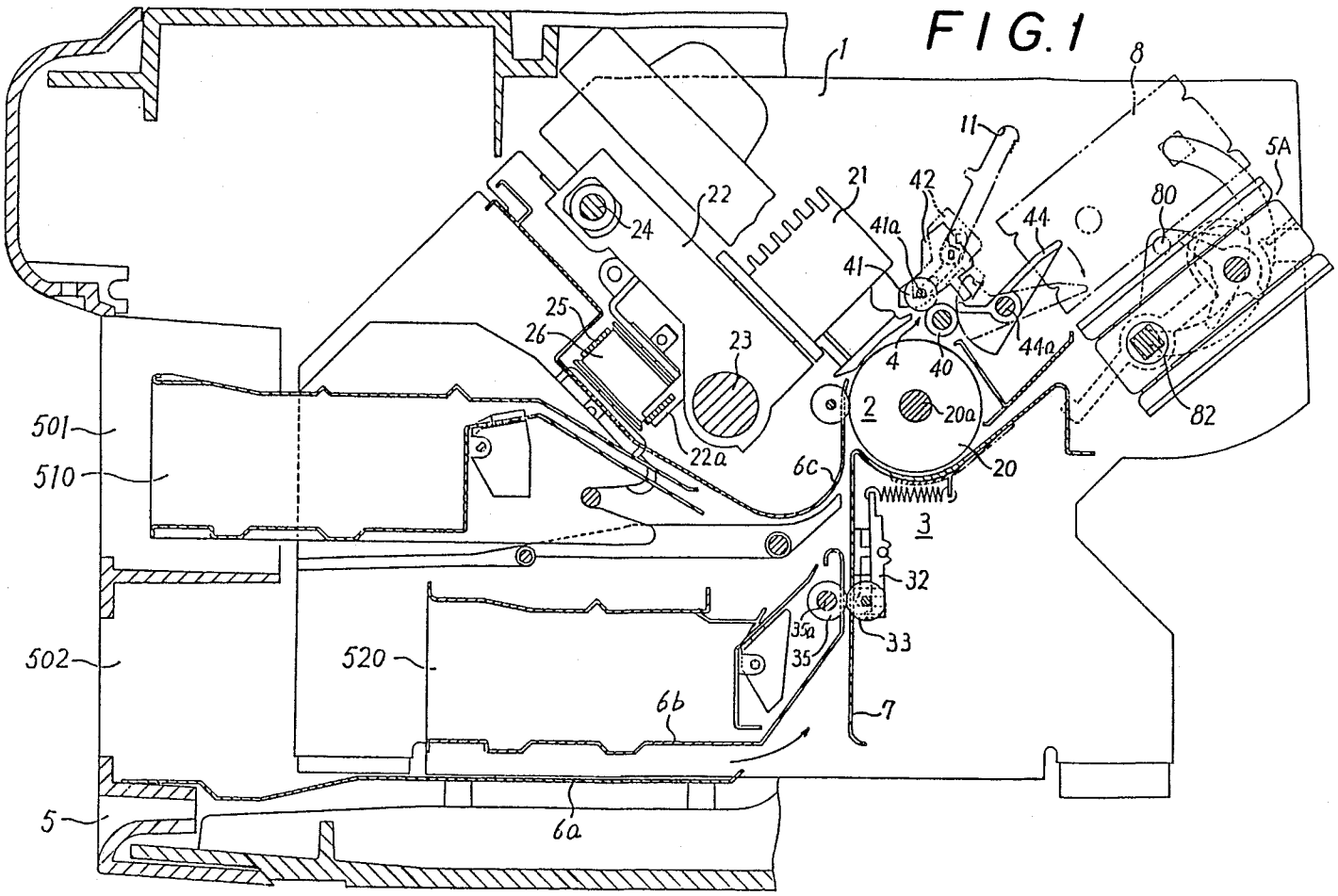
FIG. 1 is a cross-section view of a printer embodying the present invention.

In FIG. 1, opposing side plates 1 and 1A (FIG. 6) constitute a frame of a printer and supporting printing means 2. Paper feed means 3 and 4 are provided on corresponding sides of the printing means 2.

An upstream paper feed means 3 is arranged to be lower in paper feed rate than that of a downstream paper feed means 4 (functioning as paper drawing-out means when recording paper is fed forwardly) when paper is fed forwardly. This is because the printing quality is improved by doing so to thereby apply tension to the recording paper.

The specific structure of printing means 2 will now be described. A platen 20 is provided rotatable around a shaft 20*a* supported by side plate 1. A printing head 21 is provided in opposing relationship to the platen 20. The printing head 21 is mounted on a carriage 22 which is movable reciprocally along guide shafts 23 and 24 extending through the carriage 22. Drive means for the carriage 22 includes an engaging member 22*a* extending integrally from the carriage 22, and an endless drive belt 25 coupled to the engaging member 22*a* and extending around a driven pulley 26 driven by a carriage motor (not shown).

Recording paper fed through a feed opening 5 provided at a front of a housing of the printer (left side in FIG. 1) is guided by means of guide plates 6*a*, 6 *b* and 6*c* and support plate 7 between platen 20 and printing head 21 for printing purposes.

Figure 2:
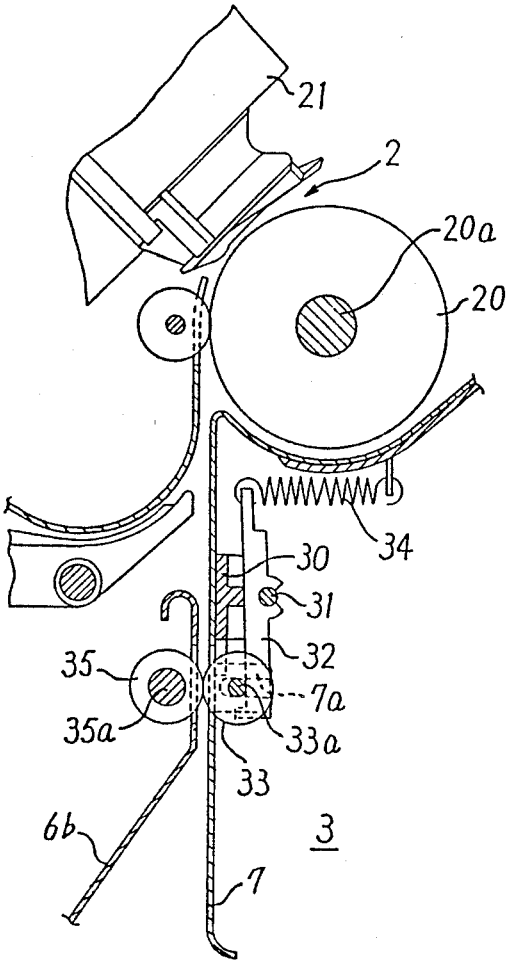
FIG. 2 is an enlarged cross-section view of paper feed means positioned on the upstream side.

The specific structure of the upstream paper feed means 3 operated when continuous paper is fed forwardly will now be described with reference to FIG. 1 and FIG. 2 in which the essential portion of the feed means 3 is shown on enlarged scale.

As described above, the side plate 1 has support plate 7 mounted thereon. A mounting plate 30 protrudes from the back of the support plate 7 and has a shaft 31 fixed thereto. A lever 32 is provided swingably on the shaft 31. Bearing groove 7*a* is provided in the support plate 7. A shaft 33*a* of a pinch roller 33 is received movably and rotatably in the groove 7*a*. A lower end of lever 32 is resiliently pushed against the shaft 33*a* of pinch roller 33. The spring force for this is derived from a spring 34 engaged with an upper end of the lever. The pinch roller 33 protrudes through a hole in the support plate 7 into a guide passageway. The pinch roller 33 is pushed resiliently against a drive roller 35 for paper feeding and protrudes into the guide passageway. The drive roller 35 is provided on drive shaft 35*a*, the drive means for which will be described in more detail later with reference to FIG. 6.

Figure 3:
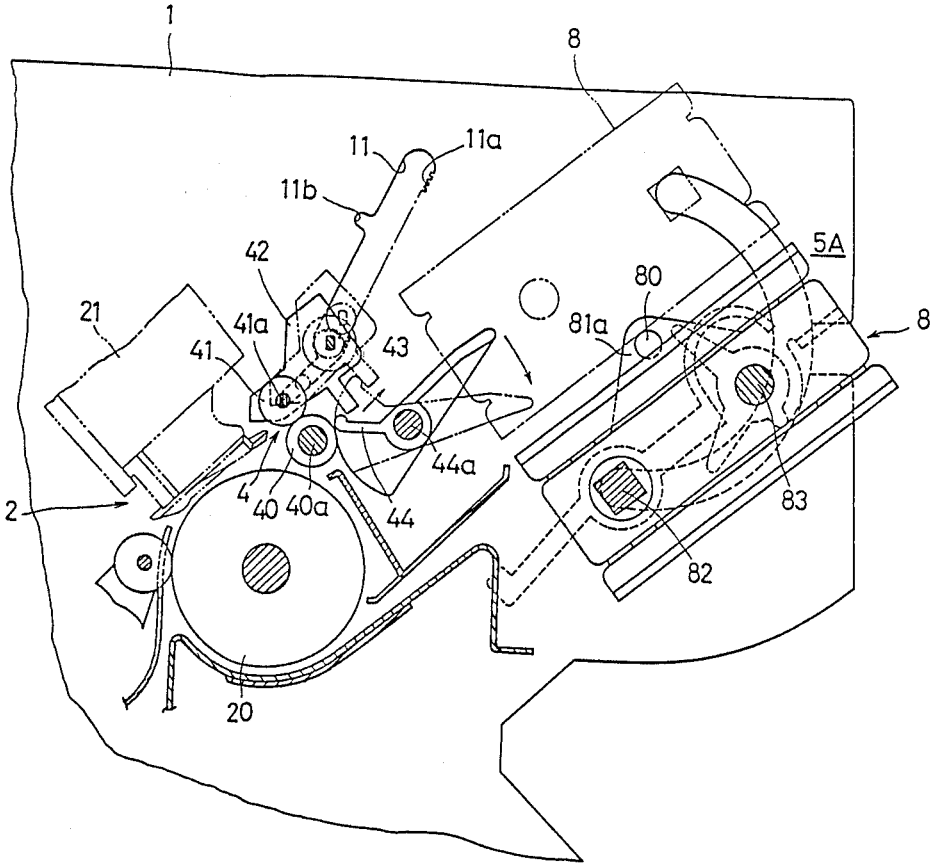
FIG. 3 is an enlarged cross-section view of paper feed means positioned on the downstream side.

The specific structure of the downstream paper feed means 4 will now be described with reference to FIG. 1 and FIG. 3 in which the essential portion of the feed means is shown on enlarged scale.

A drive roller 40 which draws out recorded paper is driven by a drive shaft 40*a*. The drive means therefor will be described later in more detail with reference to FIG. 6. A pinch roller 41 is resiliently pushed against drive roller 40 to draw out recording paper guided into between both the rollers.

Pinch roller 41 is free to be engaged with or disengaged from drive roller 40. Pinch roller 41 constitutes the downstream paper feed means. The rotational shaft 41*a* of the roller 41 is provided on a support plate 42 which has a guide shaft, for example the shaft of pinion 43, supported rotatably. The pinion 43 is positioned within a guide hole 11 provided in the side plate. Rack teeth 11*a* are formed in one inner wall surface of guide hole 11 and mesh with pinion 43. Therefore, when pinion 43 moves upwardly while meshing with rack teeth 11*a* in guide hole 11, support plate 42 also moves upwardly, so that pinch roller 41 is moved away from the surface of drive roller 40.

A similar pinch roller unit having the same structure is also provided at a corresponding position on the other side plate. The reason why rack teeth 11*a* are provided in the guide hole 11 is to equalize quantities of movement of right and left pinions 43. A recess 11*b* is formed on the other side, opposite rack teeth 11*a*, of the inner surface of the guide hole 11 in order to facilitate the manual lifting of the support plate 42 to an upper end of guide hole 11 to cause the shaft 41*a* of pinch roller 41 to be engaged in the recess to thereby facilitate exchange of an ink ribbon in this situation.

Disengagement of the pinch roller 41 from the drive roller 40 is performed by causing a pinch roller release lever 44 provided rotatable via a shaft 44*a* on side plate 1 to abut on the protrusion on support plate 42 to thereby move the support plate 42. The swinging of release lever 44 is performed in conjunction with the rotation of a tractor unit 8.

The tractor unit 8 is provided at another paper feed port 5A which feeds continuous paper and used for feeding continuous paper at this time. Drawing out recording paper can be performed by drive roller 40 and pinch roller 41 while when continuous paper is printed, the tractor unit 8 may be reversed from at port 5A and positioned at a drawing-out position in order to draw out continuous paper feed forwardly.

Figure 5:
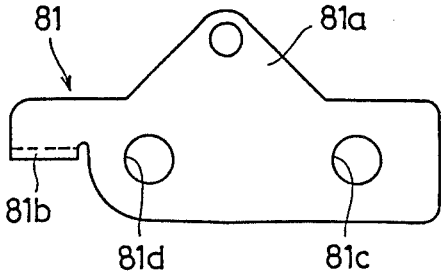
FIG. 5 is a plan view of the base plate of the tractor unit.

The specific structure of tractor unit 8 will now be described in more detail. Side plate 1 has a shaft 80 on which a protrusion 81*a* of base plate 81 is supported rotatable on which tractor unit 8 is installed. As shown in FIG. 5, base plate 81 has a through hole 81*c* through which a drive shaft 82 and a handle used to reverse tractor unit 8 extend and a through hole 81*d* through which support shaft 83 extends.

Figure 4:
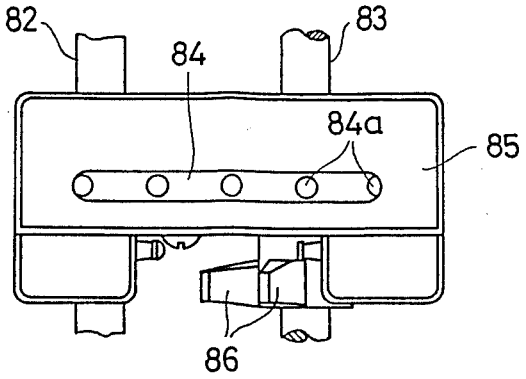
FIG. 4 is a plan view of a tractor unit.

Base plate 81 (shown in FIG. 5) is attached to each side of tractor unit 8 shown in FIG. 4. A drive wheel 87 (shown in FIG. 6) and a rotary wheel are provided rotatable in an outer frame of the unit. The drive shaft 82 and support shaft 83 support both the wheels with a drive belt 84 extending around both the rotating wheels. Drive belt 84 has protruding sprockets 84*a* on its upper surface, and under which a cover 85 is provided openable and closable. The cover 85 is opened when recording paper is replaced. A click spring is engaged with cover 85. Tractor unit 8 is adjustable in position rightward and leftward along shafts 82 and 83. A lock lever 86 is provided on support shaft 83 to lock the unit in position.

Figure 6:
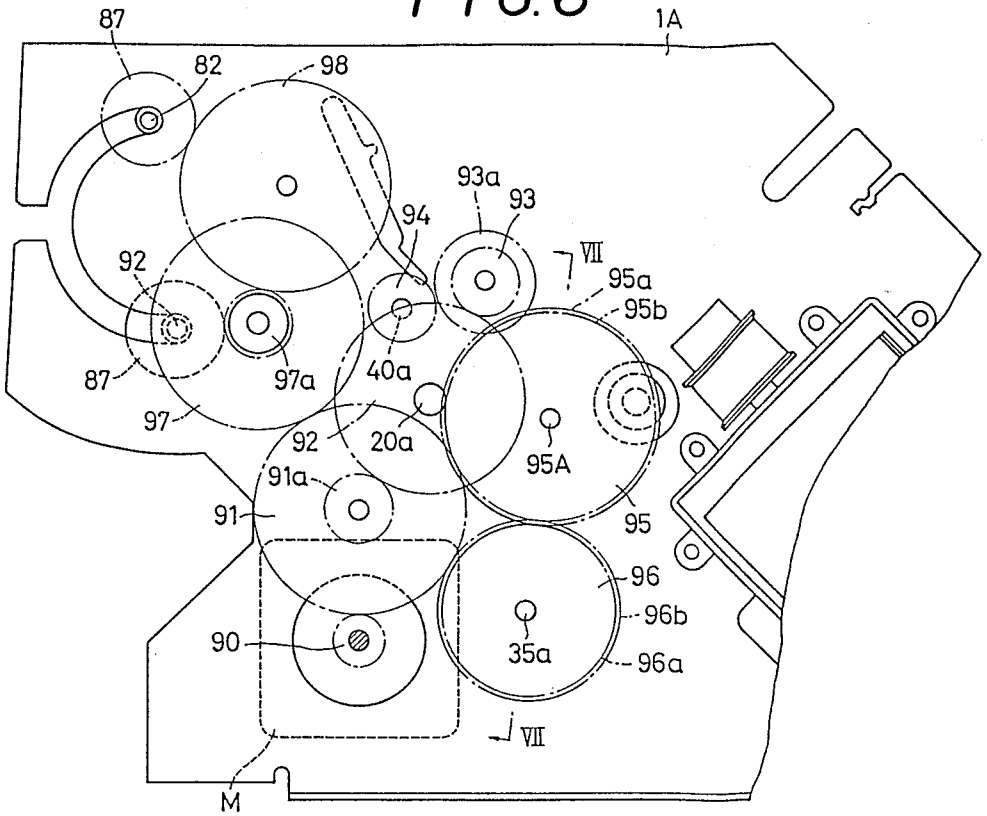
FIG. 6 is a front view of a drive gear train mechanism.

The drive wheel train mechanism of this invention will now be described with reference to FIG. 6.

A reversible paper feed motor M is installed on the other side plate 1A opposite to side plate 1. A pinion 90 supported on the drive shaft of the motor meshes with a gear wheel 91, the pinion 91*a* of which meshes with a drive gear wheel 92 which drives platen 20 and hence the shaft 20*a* of the platen. The drive gear wheel 92 of platen 20 meshes with a pinion 93, the gear wheel 93*a* of which meshes with a gear wheel 94 to drive shaft 40*a* of the wheel 94. The shaft 40*a* is the shaft of paper drawing-out drive roller 40 of the downstream paper feed means 4.

Gear wheel 91 meshes with drive gear wheel 95 supported on shaft 95A which meshes with a gear wheel 96, the shaft 35A of which is the drive shaft of drive roller 35 of the upstream paper feed means 3 to feed continuous paper toward platen 20.

Drive shaft 40*a* of drive roller 40 of the downstream paper feed means 4 is slightly higher in rate than the shaft 35*a* of drive roller 35 of upstream paper feed means 3 when the rollers are driven forwardly, as described above.

Gear wheels 95 and 96 have a mechanism which switches between the forward paper feed rate and backward paper feed rate of drive shaft 35*a*. The detailed structure of this mechanism will be described later in more detail.

Gear wheel 91 meshes with a gear wheel 97, the pinion 97*a* of which meshes with a gear wheel 98.

Pinion 97*a* is meshable with drive gear wheel 87 of tractor unit 8 when same is positioned at paper feed port 5A (paper feed position). Gear wheel 98 is meshable with drive gear wheel 87 of the unit 8 when same is reversed to the position of the downstream paper feed means 4 (shown by chain lines in FIG. 3).

Figure 7:
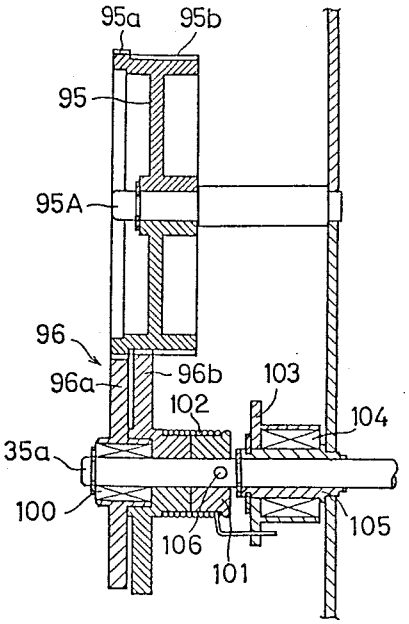
FIG. 7 is an enlarged cross-section view of taken along the line VII—VII of FIG. 6.

The mechanism which changes the paper feed rate of the upstream paper feed means 3, i.e., the mechanism by which the paper feed rate of the upstream paper feed means 3 (in this case, the term "upstream" should correctly be changed to "downstream", but it is used for the purpose of using the unified terms) is set to be greater than that of the downstream paper feed means 4 (in this case, the term "downstream" should correctly be changed to "upstream", but it is used for the same reason as just mentioned) will be described with reference to FIG. 7.

Drive gear wheel 95 which transmits a drive force to drive shaft 35*a* of drive roller 35 of the upstream paper feed means 3 includes a two-stepped one-piece structure of a larger-diameter gear portion 95*a* and a small-diameter gear portion 95*b* provided on shaft 95A coaxially. A reverse feed gear wheel 96*a* is provided on drive shaft 35*a* such that it meshes with the larger-diameter gear portion 95*a* via one-way clutch 100. A forward feed gear wheel 96*b* is fitted loosely over drive shaft 35*a* such that it meshes with smaller-diameter gear portion 95*a*, and a clutch seat 101 is coupled via a pin 106 to drive shaft 35*a*. A helically coiled clutch spring 102 is wound around the outer periphery of the shaft of forward feed gear wheel 96b and seat 101 with one end of the spring being engaged with a rotary body 103 which is supported on a bearing for the drive shaft via a one-way clutch 104 and clutch seat 105. The front (left in FIG. 1) of the housing of the printer has upper and lower paper feed ports 501 and 502 through which cut paper is fed. Cartridges (not shown) in which cut paper is accommodated are arranged to be inserted into cases 510 and 520 at the paper feed ports.

The operation of this invention will now be described. When cut paper is fed forwardly, the drive force from paper feed motor M is transmitted via gear wheel 91 to the smaller-diameter gear portion 95b of gear wheel 95. At this time, the clutch spring 102 becomes helically tensioned, so that the drive force is applied to drive shaft 35a via forward feed gear wheel 96b, and clutch seat 101. At that time, the reverse feed gear wheel 96a is also rotated, but the torque is not transmitted to drive shaft 35a because one-way clutch 100 is open.

At the same time, drive roller 40 of the downstream paper feed means 4 is rotated from gear wheel 91 via gear wheels 93a and 92 which drive platen 20, and the printed cut paper is drawn out in cooperation with pinch roller 41. The paper feed rate of drive roller 40 at that time is higher than the paper feed rate of the upstream drive roller 35.

When tractor unit 8 is used to print on continuous paper, handle 81b of unit base plate 81 is rotated by hand counterclockwise around shaft 80. This causes the unit to move through the guide groove and set at the paper drawing-out position, as shown by chain lines in FIG. 3. By the reversing operation of the tractor unit 8, the angular portion of base plate 81 rotates release lever 44 clockwise around shaft 44a, so that support plate 42 moves upward along guide hole 11, and pinch roller 41 is disengaged from drive roller 40.

Continuous paper is fed from paper feed 5 passed between pinch roller 33 and drive roller 35 and between platen 20 and printing head 21, and set at its leading at at tractor unit 8.

At that time, motor M rotates the drive gear wheel 87 of tractor unit 8 via gears 91 and 98. The paper feed rate by drive gear wheel 87 at this time is higher than the paper feed rate by the upstream drive roller 35.

The reverse feed of continuous paper using tractor unit 8 will now be described. One of the drive forces from motor M is transmitted to the upstream paper feed means 3. At this time, one-way clutch 100 is closed or engaged, so that torque is transmitted via larger-diameter gear portion 95a to reverse-feed gear wheel 96a to thereby rotate drive shaft 35a of the upstream drive roller 35. At this time, one-way clutch 104 is also closed or engaged, so that the rotary body 103 is locked on the clutch seat 105 and the clutch spring 102 becomes loosened so that the gear portion 95b freely rotates on the drive shaft 35a. Simultaneously, the drive force from motor M is transmitted to the drive shaft 82 of tractor unit 8 via gear wheels 91, 97, pinion 97a and gear wheel 98.

The torque of motor M is transmitted via larger-diameter gear portion 95a, so that the backward-feed rate becomes higher than the forward paper feed rate and transmitted more rapidly to the drive shaft 35a. Therefore, the backward feed rate is higher than the paper feed rate by the downstream drive roller 40.

Continuous paper may be fed using tractor unit 8 from paper feed port 5A. At that time, the unit may be installed in a state shown by solid lines in FIG. 1 such that continuous paper is fed between platen 20 and printing head 21 and drawn out by drive gear wheel 40 and pinch roller 41.

As described above, according to this invention, by forward and backward feed of recording paper, the selectively larger- and smaller-diameter gear portions are selectively used, so that the paper feed rate by the upstream paper feed means is changed, and hence recording paper is not slackened even if it is fed in any one of the forward and backward directions, and it is unnecessary to limit the extent or quantity of backward feed.

What is claimed:

1. An apparatus for feeding recording paper forwardly and backwardly in a printing device including a pair of paper feed means, one on each side of a printing means, the upstream paper feed means being lower in paper feed speed than the downstream paper feed means when paper is fed forwardly, the apparatus comprising:

A reversible motor rotatable in a forward and a reverse direction;

a larger-diameter gear portion and a smaller-diameter gear portion provided as a two-stepped structure on a drive gear wheel which transmits a rotary force of the reversible paper feed motor to a drive shaft of the upstream paper feed means;

a reverse-feed gear wheel mounted on the drive shaft and meshing with the larger-diameter gear portion via a one-way clutch which transmits only a reverse direction rotary force of the reversible motor to the drive shaft;

a forward-feed gear wheel loosely fitted over the drive shaft and meshing with the smaller-diameter gear portion;

a first seat coupled to the drive shaft;

a clutch spring wound around the outer periphery of a shaft of the forward-feed gear wheel and the first seat;

a rotary body engaged with one portion of the clutch spring and rotatably mounted on a second seat fixed to a supporting member and which rotatably supports the drive shaft; and a second one-way clutch on the rotary body and which permits the rotary body to rotate on the second seat via the clutch spring when the reversible motor is rotated in the forward direction whereby the clutch spring is tensed and couples the forward-feed gear wheel and the first seat so that a forward direction rotary force of the reversible motor is transmitted to the drive shaft via the forward-feed gear wheel and the clutch spring when the reversible motor is rotated in the forward direction.

2. An apparatus for feeding recording paper in forward and reverse directions in a printing device of the type having an upstream paper feed means on the upstream side of a printing means relative to the forward feed direction and a downstream paper feed means on the downstream side of the printing means, the upstream paper feed means having a lower paper feed speed than the downstream paper feed means when paper is fed forwardly to thereby tension the paper, the apparatus comprising: a rotary drive shaft for driving the upstream paper feed means in forward and reverse directions to feed paper forwardly and reversely at a paper feed speed proportional to the speed of rotation of the drive shaft; a reversible motor rotatable in forward and reverse directions of rotation; a drive gear connected to be rotationally driven by the reversible motor in forward and reverse directions and having larger-diameter and smaller-diameter gear portions; a forward-feed gear disposed on the drive shaft to undergo rotation relative thereto and being in meshing engagement with the smaller-diameter gear portion of the drive gear; first one-way clutch means mounted on the drive shaft and releasably engageable with the forward-feed gear when the reversible motor rotates in the forward direction to effect forward rotation of the drive shaft; a reverse-feed gear disposed on the drive shaft to undergo rotation relative thereto and being in meshing engagement with the larger-diameter gear portion of the drive gear; and second one-way clutch means mounted on the drive shaft and releasably engageable with the reverse-feed gear when the reversible motor rotates in the reverse direction to effect reverse rotation of the drive shaft.

3. An apparatus according to claim 2; wherein the first one-way clutch means comprises a clutch seat connected to the drive shaft adjacent the forward-feed gear, a helically coiled clutch spring disposed over adjacent portions of the forward-feed gear and clutch seat and operative when helically tensioned to releasably couple the forward-feed gear to the drive shaft, and means for effecting helical tensioning of the clutch spring when the reversible motor rotates in the forward direction.

4. An apparatus according to claim 3; wherein the second one-way clutch means is radially interposed between the drive shaft and reverse-feed gear.

5. An apparatus according to claim 3; wherein the drive gear comprises an integral one-piece structure.

6. An apparatus according to claim 5; wherein the forward-feed gear and reverse-feed gear are disposed in side-by-side relation on the drive shaft.

7. An apparatus according to claim 3; wherein the means for effecting helical tensioning comprises a second clutch seat rotatably supporting the drive shaft, a rotary member rotatably mounted on the second clutch seat and connected to an end of the clutch spring, and means for coupling and uncoupling the rotary member to and from the second clutch seat.

8. An apparatus according to claim 2; wherein the second one-way clutch means is radially interposed between the drive shaft and reverse-feed gear.

9. An apparatus according to claim 2; wherein the drive gear comprises an integral one-piece structure.

10. An apparatus according to claim 9; wherein the forward-feed gear and reverse-feed gear are disposed in side-by-side relation on the drive shaft.

* * * * *